United States Patent [19]

Kawai et al.

[11] Patent Number: 4,738,083

[45] Date of Patent: Apr. 19, 1988

[54] APPARATUS FOR SUPPLYING ARTICLES TO A HIGH-SPEED PACKING MACHINE

[75] Inventors: Koji Kawai; Hisashi Murata, both of Hiroshima, Japan

[73] Assignee: Mitsubishi Jukogyo Kabushiki Kaisha, Tokyo, Japan

[21] Appl. No.: 937,004

[22] Filed: Dec. 2, 1986

[30] Foreign Application Priority Data

Dec. 24, 1985 [JP] Japan ..... 60-291687

[51] Int. Cl.[4] ..... B65B 5/02; B65B 47/00

[52] U.S. Cl. ..... 53/579; 53/209; 53/252

[58] Field of Search ..... 53/209, 252, 566, 575, 53/579; 198/456, 600

[56] References Cited

U.S. PATENT DOCUMENTS

| | | | |
|---|---|---|---|
| 2,651,442 | 9/1953 | Malhiot | 53/252 |
| 2,885,841 | 5/1959 | Currie | 53/566 X |
| 3,193,981 | 7/1965 | Whitecar | 53/252 X |
| 3,879,920 | 4/1975 | Langen | 53/252 X |
| 4,250,693 | 2/1981 | Andersson | 53/252 X |

*Primary Examiner*—John Sipos

*Attorney, Agent, or Firm*—Wenderoth, Lind & Ponack

[57] ABSTRACT

A high-speed packing machine includes a magazine holding a plurality of flat case-forming sheets having a plurality of folding lines. These sheets are formed into U-shaped cases one after another and the cases are transported by a case conveyor. The articles to be packed are supplied by an article conveyor extending along the case conveyor. A dead plate extends from the article conveyor for receiving the articles from the article conveyor. A plurality of flight bars are provided above the dead plate for receiving the articles from the dead plate. The flight bars are movable synchronously with the article conveyor. A plurality of pushers are movable along guide rails extending below the dead plate for supplying the articles from the flight bars to the U-shaped cases on the case conveyor traveling synchronously with the article conveyor. The pushers are movable along a path extending at an angle to the conveyors.

3 Claims, 5 Drawing Sheets

APPARATUS FOR SUPPLYING ARTICLES TO A HIGH-SPEED PACKING MACHINE

BACKGROUND OF THE INVENTION

1. Field of the Invention

This invention relates to an apparatus for supplying articles to a high-speed packing machine. More particularly, it is an apparatus for delivering the articles one after another into U-shaped cases on a conveyor traveling close to the articles, while the articles and the cases are moved forward at the same speed.

2. Description of the Prior Art

A conventional packing machine is schematically shown in FIG. 7. FIG. 7 illustrates the steps of sheet delivery, articles feeding, case forming, paste coating, pressure application and bonding. A magazine M disposed in an inclined position holds a plurality of flat caseforming sheets 02 each having a plurality of folding lines formed thereon. The sheets 02 are one after another delivered from the magazine M by a sheet delivering device 01, and are formed into U-shaped cases 02'. The cases 02' are delivered onto a case conveyor 03 one after another at appropriate intervals. A plurality of articles 04 to be packed are supplied synchronously with the cases 02' along a path close to the conveyor 03. Each article 04 is fed into one of the cases 02'. As the case 02' holding the article 04 is moved forward on the conveyor 3, the side seams and the upper and lower flaps are folded along the folding lines. The subsequent steps of paste coating, pressure application and bonding are also carried out on the conveyor 03.

FIG. 8 shows a typical apparatus which has been conventionally used for feeding the articles into the cases. It includes an article conveyor 05, a bucket conveyor 06 for conveying appropriately grouped articles 04 and an article loading pusher 07. A roller 08 is provided at the rear end of the pusher 07. A guide rail 09 is provided for the pusher 07. Levers 010 are rotatable about a guide rail 011 by an overload when the article 04 is loaded. They are connected by a tie rod 012.

Each group of articles 04 arriving at the bucket conveyor 06 from the article conveyor 05 are pushed by the pusher 07 into the cases 02' on the case conveyor 03. The apparatus also includes a mandrel 013 provided on the opposite sides of the conveyors from the pusher 07. A roller 08 and a guide rail 014 are provided for the mandrel 013. The rollers 08 are movable along the guide rails 09 and 014, respectively. As the rollers 08 are moved, the pusher 07 and the mandrel 013 are moved along the guide rails toward each other until the articles 04 are completely inserted into the cases 02'. The cases 02' holding the articles 04 are transferred by the conveyor 03 to allow for the subsequent steps of folding, paste coating and bonding to be performed.

According to the conventional apparatus as hereinabove described, the bucket conveyor is moved synchronously with the case conveyor, and the pusher and mandrel disposed on the opposite sides of the conveyors from each other are moved for loading the cases with the articles. A large space is required on either side of the conveyors for accommodating the pusher of mandrel and the mechanism associated therewith. A long time is required to adjust the operational timing of each conveyor, the pusher and the mandrel. A long time is also required to perform their maintenance.

SUMMARY OF THE INVENTION

It is, therefore, an object of this invention to provide an improved apparatus which can supply cases to a high-speed packing machine continously, which is simple in construction, and which can thereby contribute greatly to a cost reduction and an improvement in productivity.

This object is attained by an apparatus which is is particularly featured by including a dead plate extending from an article conveyor for receiving articles therefrom, a plurality of flight bars located above the dead plate and capable of moving synchronously with the article conveyor, and a pusher which is movable perpendicularly to a case conveyor and synchronously therewith along guide rails provided below the dead plate for supplying the articles continuously to U-shaped sheets on the case conveyor traveling synchronously with the article conveyor.

This invention enables a high-speed packing machine which is compact to be realized, can be installed in a smaller space, is easy to maintain and has an improved working efficiency.

DETAILED DESCRIPTION OF THE PREFERRED EMBODIMENT

Figure 7:
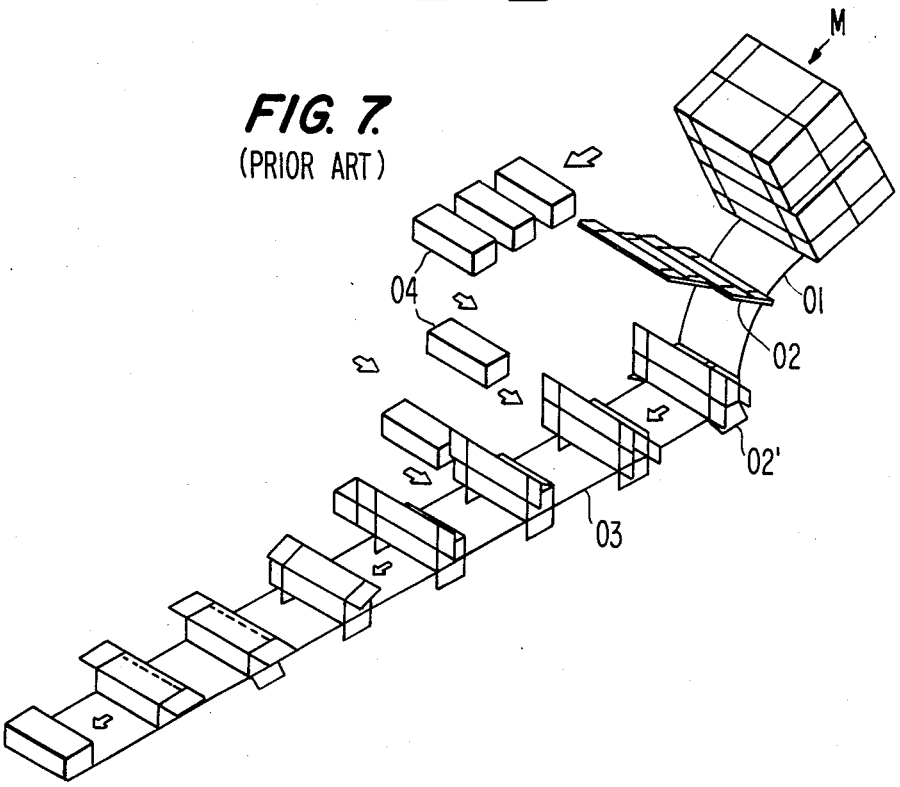
FIG. 7. (PRIOR ART)
FIG. 7 is a schematic view illustrating the steps of the packing operation performed by a conventional machine.
Figure 8:
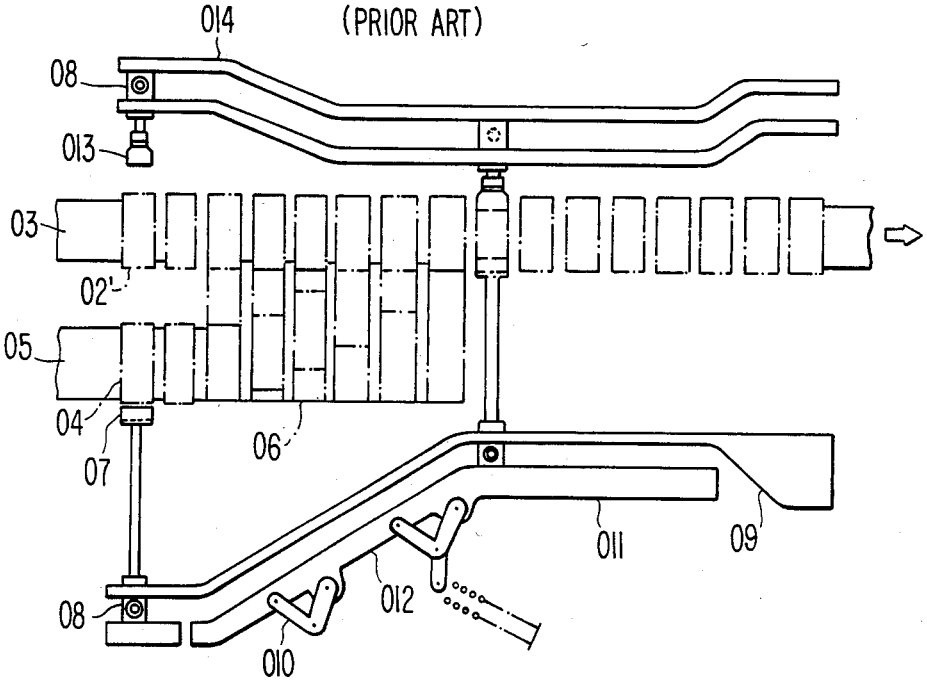
FIG. 8. (PRIOR ART)
FIG. 8 is a top plan view of a conventional apparatus for supplying articles to the packing machine.

An apparatus according to the present invention is shown in FIGS. 1 to 5. A plurality of sheets 02 leaving an inclined magazine 1 are formed into U-shaped cases 2 by a sheet delivering device of the type shown at 01 in FIG. 7. The U-shaped cases 2 are delivered to the buckets which are provided on a case conveyor 3 at appropriate intervals in an endless pattern. The articles 5 to be packed are appropriately grouped and transported at appropriate intervals by an article grouping conveyor 4 extending along the case conveyor 3 and traveling synchronously therewith. The articles 5 are delivered from the grouping conveyor 4 to a dead plate 6 extending from the grouping conveyor 4. The conveyor 4 and the dead plate 6 lie in a common horizontal plane. The articles 5 are, then, delivered from the dead plate 6 to a plurality of flight bars **9*c* that are provided above the dead plate 6 and are attached to endless flight bar moving chains 9*a* and 9*b* extending about shafts 7 and 8. The chains 9*a* and 9*b* and, therefore, the flight bars 9*c* are movable synchronously with the grouping conveyor 4**.

The shafts 7 and 8 consist of a pair of vertically spaced apart shafts 7 and a pair of vertically spaced apart shafts 8. Each shaft 7 or 8 is rotatably supported at both ends thereof by bearings **7*a* or 8*a* on a base 7*c* or 8*c* secured to a machine frame F. A chain wheel 7*b* or 8*b* is provided at each end of each shaft 7 or 8**. The chains 9*a* and 9*b* are rotatably engaged with the chain wheels 7*b* and 8*b*. The shafts 7 and 8 are driven by a driving chain wheel 7*d* connected to a source of driving power not shown.

A driven shaft 10 and a driving shaft 11 are rotatably supported on the frame F below the dead plate 6. A pair of endless pusher moving chains 12*a* and 12*b* extend about chain wheels 10*a* and 10*b* on the shaft 10 and chain wheels 11*a* and 11*b* on the shaft 11. A plurality of appropriately spaced apart pusher guides 13*a* and 13*b* extend between the chains 12*a* and 12*b*. Each end of each pusher guide is secured to a pin on one of the chains. An endless belt 10*c* carrying a plurality of appropriately spaced apart guide plates 10*d* thereon is secured to pins on the chain 12*b*.

Figure 1:
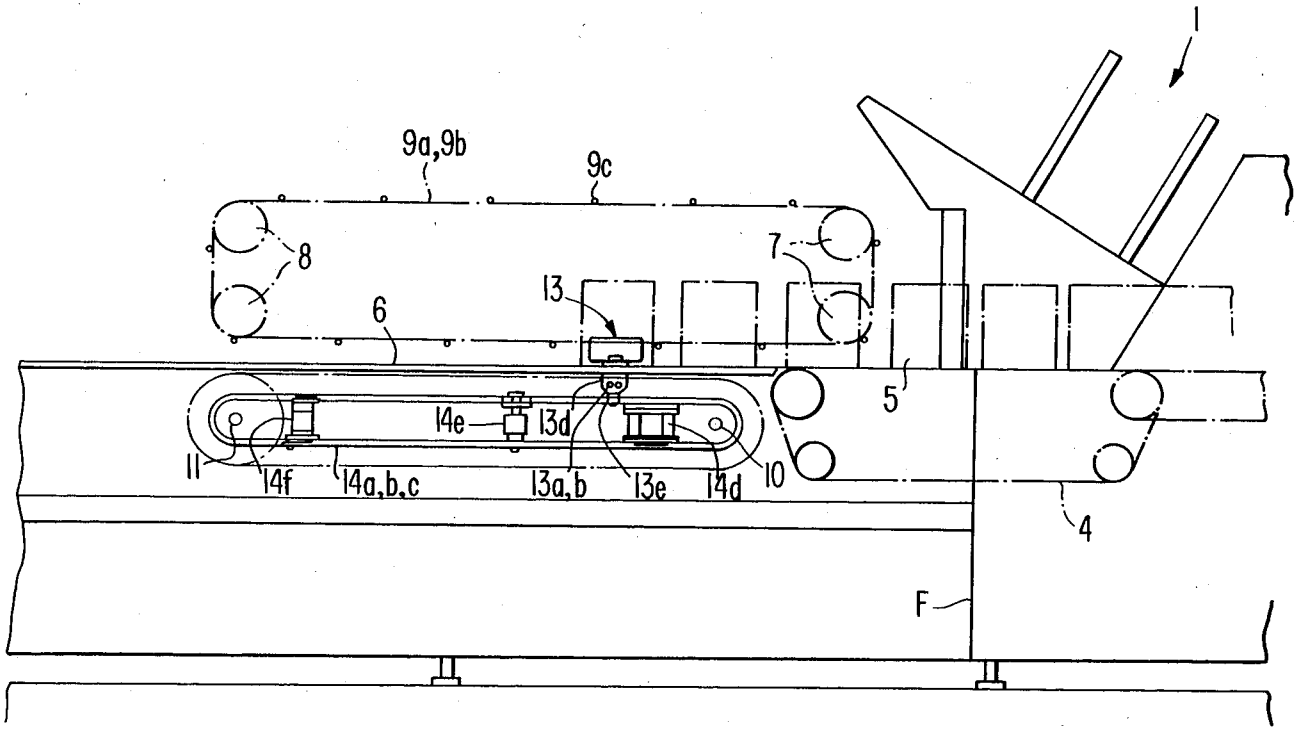
FIG. 1 is a side elevational view of an apparatus according to the present invention.
Figure 2:
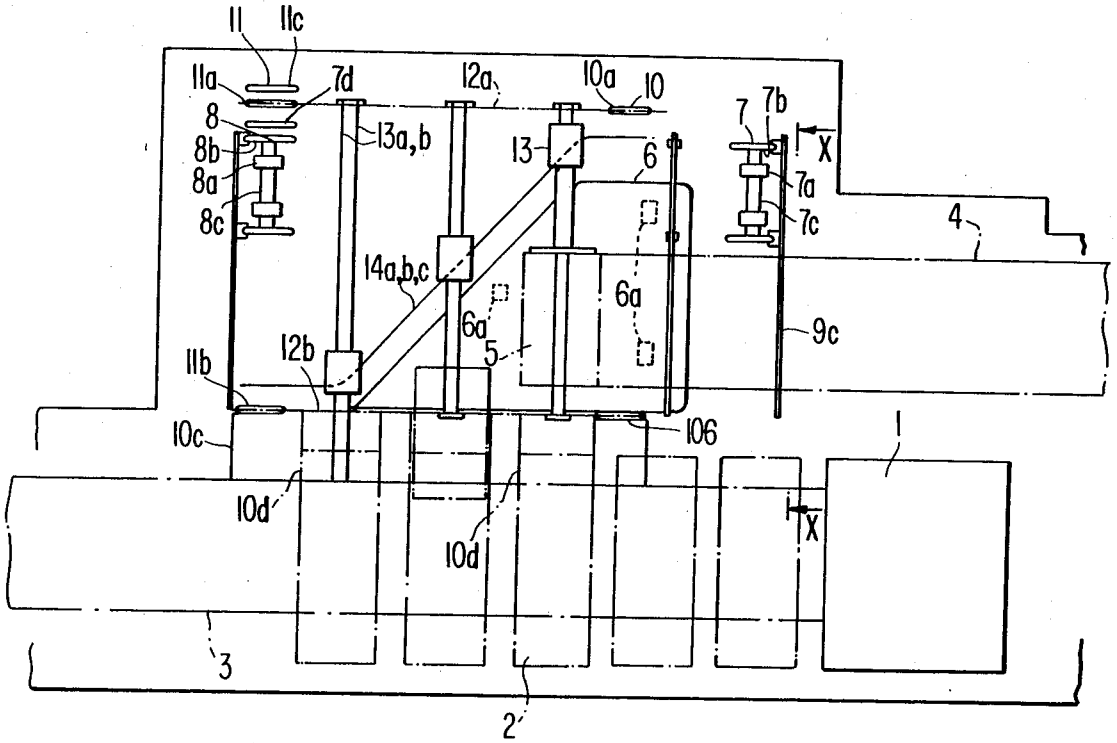
FIG. 2 is a top plan view thereof.
Figure 3:
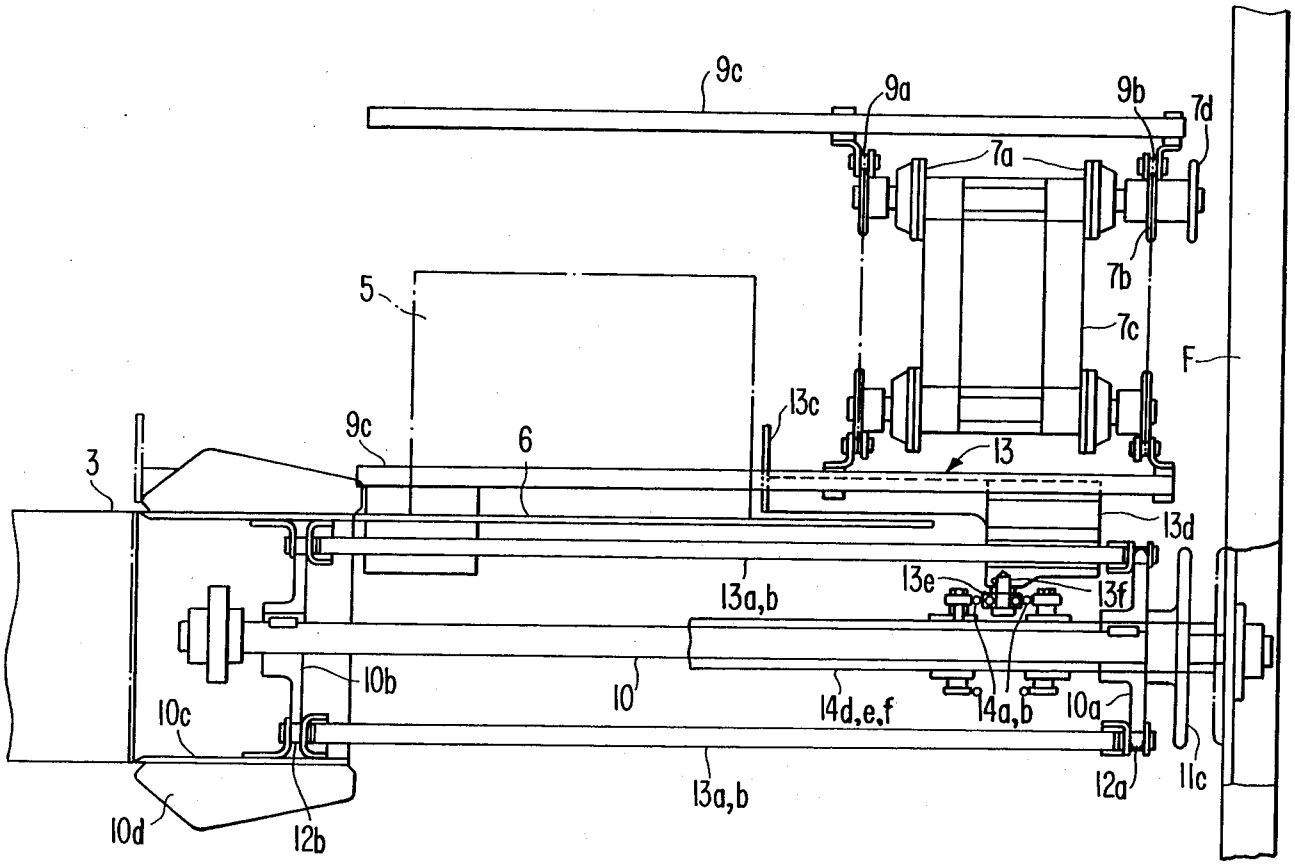
FIG. 3 is a sectional view taken along the line X—X of FIG. 2.
Figure 4:
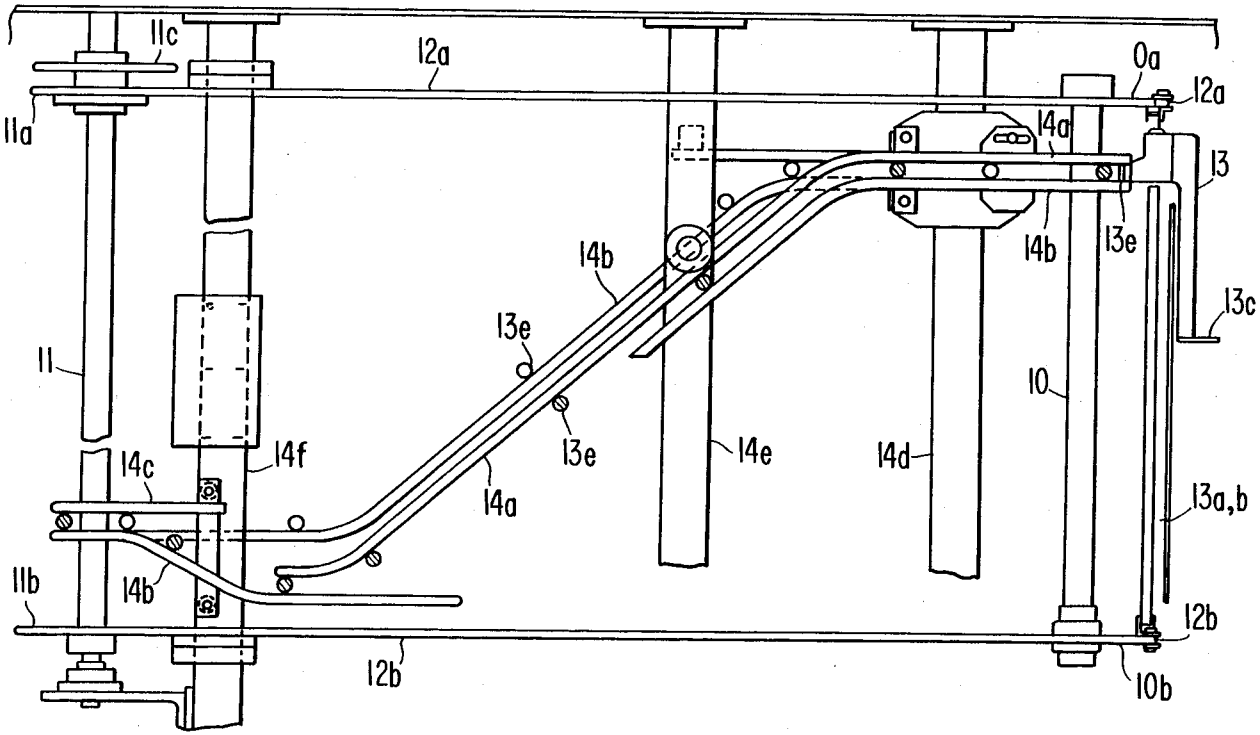
FIG. 4 is a top plan view of guide rails.
Figure 5:
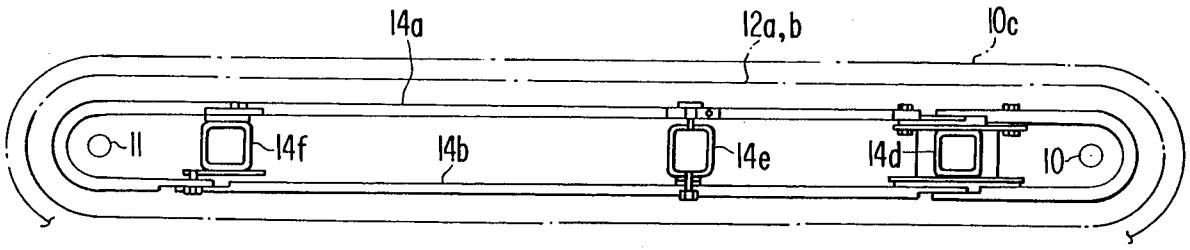
FIG. 5 is a side elevational view of the guide rails.
Figure 6:
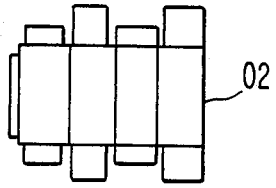
FIG. 6 is a top plan view of a case-forming sheet having a plurality of folding lines.

A plurality of beams 14*d*, 14*e* and 14*f* extend parallel to the shafts 10 and 11. The opposite ends of each beam are secured to the frame F on the opposite sides of the chains 12*a* and 12*b* from each other. A plurality of endless guide rails 14*a*, 14*b* and 14*c* extend about the beams 14*d* to 14*f*, as shown in FIG. 5. The dead plate 6 is secured to the frame F at a plurality of points 6*a*.

A plurality of pushers 13 are movable along the guide rails 14*a* to 14*c* at an angle to the direction of travel of the articles 5 for transferring the articles 5 to the cases 2 on the case conveyor 3. The pusher 13 which has transferred the articles 5 to the case 2 is moved back along the guide rails 14*a* to 14*c* below the beams 14*d* to 14*f* to its original position.

The pusher moving chains 12*a* and 12*b* and the case conveyor 3 are driven synchronously with each other. The pusher 13 comprises a pusher plate 13*c* and a main body 13*d* provided with pusher guides 13*a* and 13*b*. A cam follower 13*e* is connected to the bottom of the main body 13*d* by a pin 13*f* and rotatably contacts the guide rails 14*a* and 14*b*. When the chains 12*a* and 12*b* are moved, the pusher 13 is moved along the guide rails 14*a* and 14*b* along an inclined path above the dead plate 6 for delivering the article 5 to the case conveyor 3. The articles 5 which have been supplied at appropriate intervals along the inclined path on the dead plate 6 by the flight bars 9*c* are fed on after another into the cases 2 on the case conveyor 3 along the guide plates 10*d* on the endless belt 10*c*. The endless belt 10*c* is driven by a driving chain wheel 11*c* secured to the driving shaft 11 and connected to a source of driving power not shown.

The cases 2 holding the articles 5 are subjected to the steps of seam and flap folding, paste coating, pressure application and bonding to form completely closed packages, while they are transported on the case conveyor 3.

What is claimed is:

1. In an apparatus for supplying articles to a high-speed packing machine including a magazine for holding a plurality of flat case-forming sheets each having a plurality of fold lines about which the flat sheets are foldable, a device for successively forming the sheets into U-shaped cases, a case conveyor for transporting the U-shaped cases in a case transporting direction, and an article conveyor travelling synchronously with the case conveyor, the article conveyor for conveying the articles alongside the case conveyor, the improvement comprising:

a dead plate extending from the article conveyor in said case transporting direction for receiving the articles therefrom;

a plurality of flight bars extending above said dead plate and movable in the case transporting direction for moving the articles along the dead plate in the case transporting direction, and means for moving said flight bars in synchronism with the article conveyor; and a plurality of pushers movable along a plurality of guide rails extending below said dead plate in a pushing direction extending at an angle to said case transporting direction for pushing the articles along the dead plate in said pushing direction from the dead plate to the U-shaped cases transported by the case conveyor as the articles are moved by said flight bars.

2. An apparatus as claimed in claim 1, and further comprising a plurality of chains on which said pushers are carried.

3. An apparatus as claimed in claim 2, and further comprising an endless belt connected to one of said chains, and a plurality of guide plates carried by said endless belt for guiding the articles to the U-shaped cases as the articles are pushed by said pushers.

* * * * *